US009704684B2

(12) United States Patent
Wahrenburg et al.

(10) Patent No.: US 9,704,684 B2
(45) Date of Patent: Jul. 11, 2017

(54) CIRCUIT BREAKER CROSSBAR ASSEMBLY

(71) Applicant: General Electric Company, Schenectady, NY (US)

(72) Inventors: Christoper Paul Wahrenburg, Madison, CT (US); Christine Marie Barbera, Middlebury, CT (US); Katherine Coughlin, West Hartford, CT (US); Ansel Omar Reid, Middletown, CT (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 12 days.

(21) Appl. No.: 14/858,143

(22) Filed: Sep. 18, 2015

(65) Prior Publication Data

US 2016/0104594 A1 Apr. 14, 2016

Related U.S. Application Data

(60) Provisional application No. 62/061,533, filed on Oct. 8, 2014.

(51) Int. Cl.

| | |
|---|---|
| ***H01H 1/22*** | (2006.01) |
| ***H01H 71/02*** | (2006.01) |
| ***H01H 71/50*** | (2006.01) |

(52) U.S. Cl.

CPC ..... *H01H 71/0207* (2013.01); *H01H 71/505* (2013.01)

(58) Field of Classification Search

CPC ..... H01H 71/1009; H01H 71/1027; H01H 71/1036; H01H 1/22; H01H 1/225; H01H 2009/0088

(Continued)

(56) References Cited

U.S. PATENT DOCUMENTS 4,128,822 A * 12/1978 Peterson, Jr. ..... H01H 71/1009 335/8

4,680,564 A 7/1987 DiMarco et al.

(Continued)

OTHER PUBLICATIONS

Delgado-Frias et al., "A VLSI Crossbar Switch With Wrapped Wave Front Arbitration", Circuits and Systems I: Fundamental Theory and Applications, IEEE Transactions, vol. 50 , Issue: 1, Jan. 2003, pp. 135-141.

*Primary Examiner* — Vanessa Girardi

(74) *Attorney, Agent, or Firm* — GE Global Patent Operation; Stephen G. Midgley

(57) ABSTRACT

A circuit breaker crossbar assembly includes an elongate crossbar having a longitudinal axis, a first end and a second end, and having at least one support portion disposed therebetween. The crossbar is rotatable with respect to the longitudinal axis between a first rotational position and a second rotational position. The crossbar is coupleable to a plurality of moveable contacts of the circuit breaker. The support portion includes a first stop wall and a second stop wall defining a recess therebetween. A support structure is disposed in the recess, and comprises a support end pivotally coupled to the crossbar. The support structure has a first wall arranged to engage the first stop wall upon rotation of the crossbar toward the first rotational position, and a second wall arranged to engage the second stop wall upon rotation of the crossbar toward the second rotational position.

17 Claims, 5 Drawing Sheets

(58) Field of Classification Search
USPC ..... 200/244, 239
See application file for complete search history.

(56) References Cited

U.S. PATENT DOCUMENTS

| | | | | |
|---|---|---|---|---|
| 5,057,806 | A | 10/1991 | McKee et al. | |
| 5,270,564 | A | 12/1993 | Parks et al. | |
| 5,502,428 | A | 3/1996 | McColloch et al. | |
| 5,633,483 | A | 5/1997 | Oster et al. | |
| 6,252,480 | B1 | 6/2001 | Kramer | |
| 7,238,910 | B1 | 7/2007 | Puskar et al. | |
| 9,384,912 | B2 * | 7/2016 | Curnis | H01H 3/38 |
| 2012/0298489 | A1 | 11/2012 | Fong et al. | |

* cited by examiner

CIRCUIT BREAKER CROSSBAR ASSEMBLY

CROSS-REFERENCE TO RELATED APPLICATION

This non-provisional application claims the benefit of priority under 35 U.S.C. §119(e) to U.S. Provisional Patent Application No. 62/061,533, entitled "CIRCUIT BREAKER CROSSBAR ASSEMBLY", filed Oct. 8, 2014, which is herein incorporated in its entirety by reference.

BACKGROUND OF THE INVENTION

The subject matter disclosed herein relates to circuit breakers and, more particularly to a circuit breaker crossbar assembly.

Multi-phase industrial electrical power distribution systems are protected against damage from overcurrent circuit conditions by corresponding single or multi-pole circuit breakers wherein each phase of the power distribution circuit is directed through a separate pole within the circuit breaker assembly. The overcurrent situations may be caused, for example, by short circuits or ground faults in or near such equipment. A circuit breaker may be manually switched from an "ON" condition to an "OFF" condition and vice versa. Additionally, the circuit breaker typically includes a mechanism that is configured to automatically switch the circuit breaker to an "OFF" (e.g., "TRIP") condition in response to an undesirable operating situation, such as a short circuit, for example.

Circuit breakers typically include at least one pair of separable main contacts housed within a housing which typically comprises a base and a corresponding cover. The separable contacts may be operated either manually by way of an operating handle disposed on the outside of the circuit breaker housing and in operative communication with an operating mechanism disposed within the circuit breaker housing, or automatically in response to an overcurrent condition. In the automatic mode of operation, the contacts may be opened by an operating mechanism, controlled by a trip unit, or by magnetic repulsion forces generated between the stationary and movable contacts during relatively high levels of over current. Because of the potential for damage caused by the overcurrent conditions, it is desirable to trip the circuit breaker as rapidly as possible to interrupt the current flow through the circuit breaker.

Typically, the at least one pair of separable main contacts comprise a moveable contact and a stationary contact, wherein the moveable contact is selectively moved by the operating mechanism between the ON condition in contact with the stationary contact, and the OFF position separate from the stationary contact, and vice versa. The circuit breaker operating mechanism often includes a crossbar unit that is operatively coupled to the movable contact and arranged to rotate or otherwise move the moveable contacts between the ON and OFF conditions. Several components associated with crossbar operation are required to maintain proper positioning of the crossbar and to ensure that the rotation of the crossbar is limited to a predetermined rotational travel distance. The associated components undesirably impart a high degree of friction on the crossbar, such that tripping of the circuit breaker is longer in duration than a crossbar that experiences lower friction. Therefore, the number of necessary components and the associated frictional forces are undesirably high. Often, grease or other lubricant is required to be applied to the crossbar and supports, increasing costs. It thus would be desireable to provide a circuit breaker having fewer operating mechanism parts that can provide a more rapid tripping response.

BRIEF DESCRIPTION OF THE INVENTION

According to one aspect of the invention, a circuit breaker crossbar assembly includes an elongate crossbar comprising a longitudinal axis defining a first end and a second end and at least one support portion disposed therebetween, the first end and the second end each rotatable with respect to the longitudinal axis between a first rotational position and a second rotational position, the crossbar operably coupleable to a plurality of moveable contacts of the circuit breaker. The crossbar further comprises a first stop wall and a second stop wall defining a recess therebetween. A support structure is operatively disposed in the recess, the support structure having a support end pivotally coupled to the crossbar, a first support wall arranged to operably engage the first stop wall upon rotation of the crossbar to the first rotational position, and a second support wall arranged to operably engage the second stop wall upon rotation of the crossbar to the second rotational position.

According to another aspect of the invention, a circuit breaker includes a plurality of moveable contacts configured to conduct current through the circuit breaker. Also included is a mechanism configured to actuate movement of the plurality of moveable contacts, a first bracket located on a first side of the circuit breaker, and a second bracket located on a second side of the circuit breaker. Further included is an elongate crossbar comprising a longitudinal axis defining a first end operatively coupled to the first bracket, a second end operatively coupled to the second bracket, and at least one support portion disposed therebetween, the first end and the second end each rotatable between a first rotational position and a second rotational position and operatively coupled to the mechanism and to the plurality of moveable contacts to rotate the plurality of moveable contacts. The crossbar further comprises a first stop wall and a second stop wall defining a recess therebetween. Yet further included is a support structure disposed in the recess, the support structure having a support end rotatably coupled to the crossbar, a first support wall arranged to operably engage the first stop wall upon rotation of the crossbar to the first rotational position, and a second support wall arranged to operably engage the second stop wall upon rotation of the crossbar to the second rotational position.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
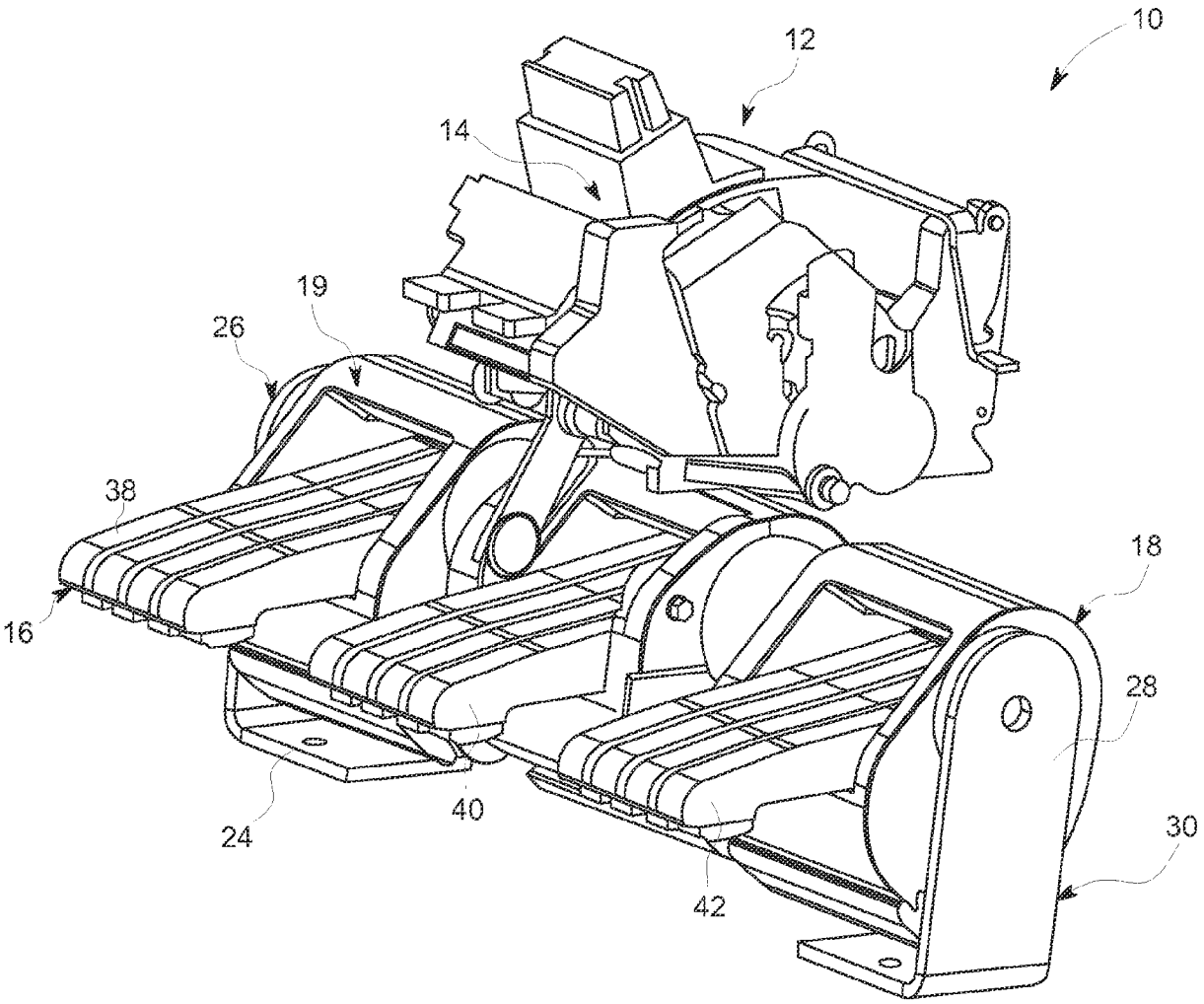
FIG. 1 is a perspective view of a circuit breaker.
Figure 2:
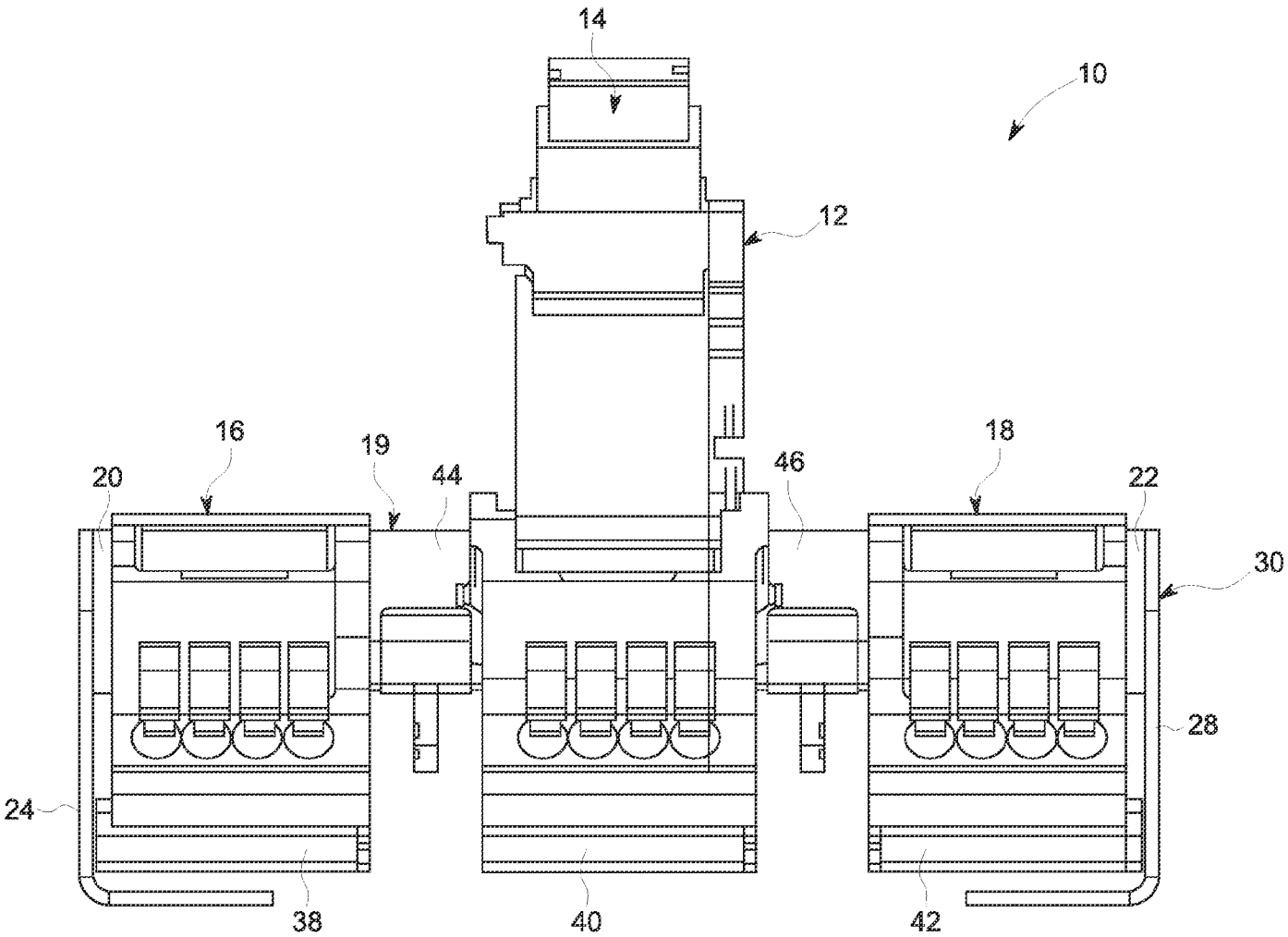
FIG. 2 is a front elevation view of the circuit breaker.

Referring to FIGS. 1 and 2, a circuit breaker 10 of the multi-pole variety is partially illustrated. A cover and housing of circuit breaker 10 is omitted for clarity to better illustrate various components of the circuit breaker 10 that are relevant to the embodiments described herein. The circuit breaker 10 includes a mechanism 12 that is generally referenced with numeral 12. The mechanism 12 includes a number of components configured to detect a hazardous or other undesirable operating condition and to initiate switching the circuit breaker 12 to a tripped or "OFF" condition. Additionally, manual manipulation of the condition of the circuit breaker 10 is facilitated with a handle 14 that may be actuated by an operator. This gives the operator the ability to turn the circuit breaker 10 to an "ON" condition, for example to energize a protected circuit, by manipulating the handle 14 to operate mechanism 12 to close the circuit breaker contacts; and similarly, to selectively switch the circuit breaker to an "OFF" condition, for example to disconnect the protected circuit, by manipulating the handle 14 to operate mechanism 12 to open or separate the circuit breaker contacts Additionally the handle 14 may also be manipulated by a user to reset the circuit breaker from a "TRIPPED" condition after a fault. Overall, the mechanism 12 converts movement of the handle 14 into mechanical force to operate the circuit breaker 10.

The circuit breaker 10 illustrated depicts a three-phase configuration, however, the embodiments disclosed herein are not limited to this configuration, such that alternative phase configurations (e.g., one-phase, two-phase, four-phase, etc.) may be employed. Specifically, three moveable contacts 16 are illustrated. The moveable contacts 16 are conductors configured for selective movement by the operating mechanism 12. For example, the moveable contacts may be rotated by the operating mechanism between the ON and OFF conditions. The moveable contacts 16 are in mechanical communication with a crossbar assembly 18 that includes a crossbar 19. In an embodiment, the moveable contacts 16 are disposed, at least partially, within the crossbar assembly. The crossbar 19 defines a longitudinal axis and extends from a first end 20 to a second end 22. The first end 20 of the crossbar 19 is operatively coupled to a first bracket 24. In an embodiment, first bracket 24 is disposed on a first side 26 of the circuit breaker 10. Similarly, the second end 22 of the crossbar 19 is operatively coupled to a second bracket 28. In an embodiment, second bracket 24 is disposed on a second side 30 of the circuit breaker 10. It will be understood that any number of brackets may be coupled to support crossbar 19 in any number of locations that allow it to function as described herein. The first end 20 and the second end 22 of crossbar 19 are rotatably coupled to the respective brackets 24, 28. The coupling may be made with any suitable coupling that allows a rotation of the crossbar 19 with respect to the longitudinal axis, such as with pin joint connections.

In operation, the crossbar 19 rotates around longitudinal axis CA upon an actuation from the mechanism 12 to either drive the moveable contacts 16 into a position that either renders the circuit breaker in the "ON" condition, the "OFF" condition, or the "TRIP" condition. Specifically, in the event an operator manually turns the circuit breaker 10 toward the ON condition, the mechanism 12 interacts with the crossbar 19, which rotates and drives the moveable contacts 16 toward a closed position with respect to corresponding stationary contacts (not shown) of circuit breaker 10. In the event an operator manually turns the circuit breaker handle 14 toward an OFF condition, or if the mechanism automatically initiates a tripping sequence, the mechanism 12 interacts with the crossbar 19, which rotates to thereby move the moveable contacts 16 away from the corresponding stationary contacts (not shown) of circuit breaker 10 toward an open position.

Figure 3:
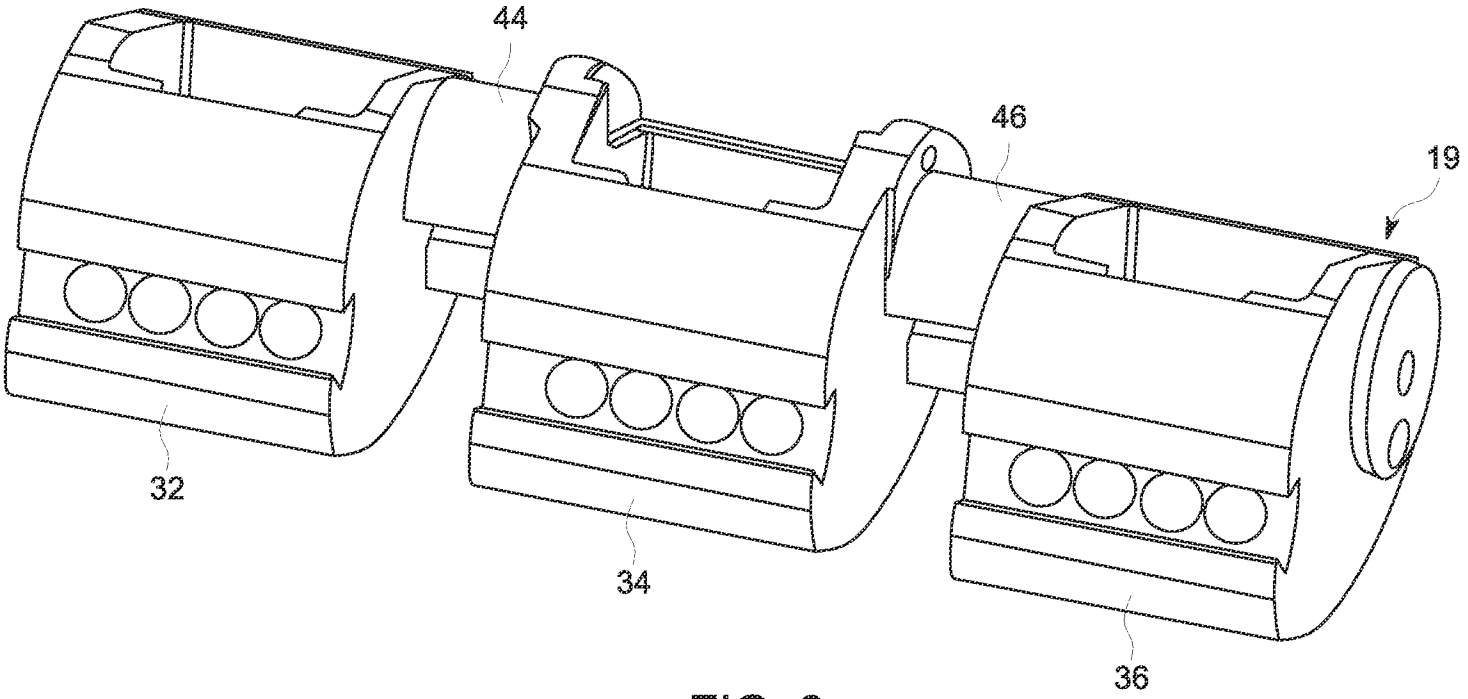
FIG. 3 is a perspective view of a circuit breaker crossbar assembly.

Referring now to FIG. 3, the crossbar assembly 18 is illustrated in greater detail. The crossbar 19 includes multiple segments that are operatively coupled to the moveable contacts 16. In the illustrated exemplary embodiment having three moveable contacts, a first segment 32, a second segment 34 and a third segment 36 are included to correspond to the number of moveable contacts 16. In such an embodiment, the first segment 32 is associated with a first moveable contact 38, the second segment 34 is associated with a second moveable contact 40 and the third segment 36 is associated with a third moveable contact 42 (FIGS. 1 and 2). Additionally, the crossbar 19 includes at least one support portion. For example, in an embodiment, at least one support portion of the crossbar 19 may be disposed between each pair of segments. In the illustrated exemplary embodiment, a first support portion 44 is disposed between the first segment 32 and the second segment 34 of the crossbar 19, and therefore between the first moveable contact 38 and the second moveable contact 40. Similarly, a second support portion 46 is disposed between the second segment 34 and the third segment 36 of the crossbar 19, and therefore between the second moveable contact 40 and the third moveable contact 42. As noted above, the number of segments and moveable contacts may vary depending upon the particular circuit breaker and as a result it is to be appreciated that the number of support portions and their respective locations, may likewise vary.

Figure 4:
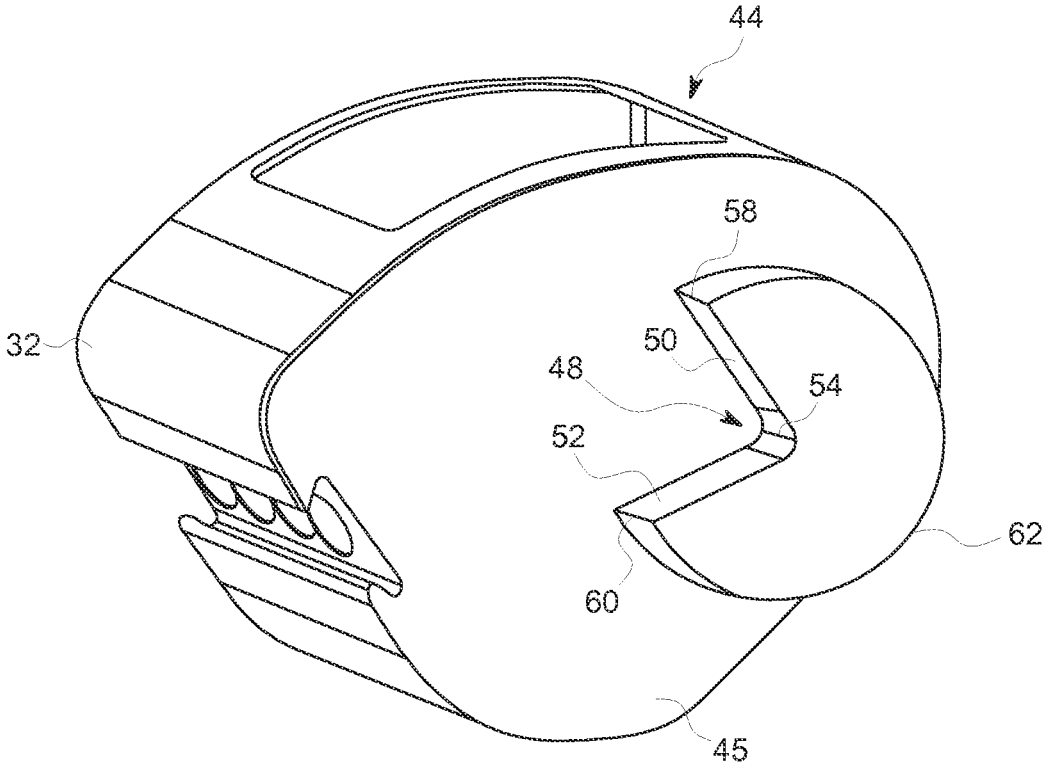
FIG. 4 is a perspective view of a segment of the circuit breaker crossbar assembly.

Referring now to FIG. 4, illustrated is one of the coupling segments of the crossbar 19, as well as an adjacent segment of the crossbar 19. For purposes of discussion and clarity herein, only a single support portion and a single adjacent segment of the crossbar 19 will be described in detail and reference numeral 44 will be employed in reference to the support portion and reference numeral 32 will be employed to refer to the adjacent segment.

In the illustrated embodiment, the first support portion 44 is a segment of a body 45 that is substantially circular in shape. However, it is to be appreciated that alternative geometries may be employed to configure the first support portion 44. Irrespective of the employed geometry, a cutout portion, such as a recess 48 is defined by the body 45. For example, in an embodiment, the body 45 comprises a first stop wall 50 and a second stop wall 52 defining the recess 48 therebetween. In an embodiment, the first stop wall 50 and the second stop wall 52 intersect at an inner surface 54 that is defined by an intersection of the first stop wall 50 and the second stop wall 52. For example, the inner surface 54 may be radially disposed from an outer surface. The first stop wall 50 extends from the radially disposed inner surface 54 to a first stop wall outer end 58 and the second stop wall 52 extends from the radially inner surface 54 to a second stop wall outer end 60. In other embodiments, the inner surface 54 is a concave surface coupled to and disposed between the first stop wall 50 and the second stop wall 52.

Figure 5:
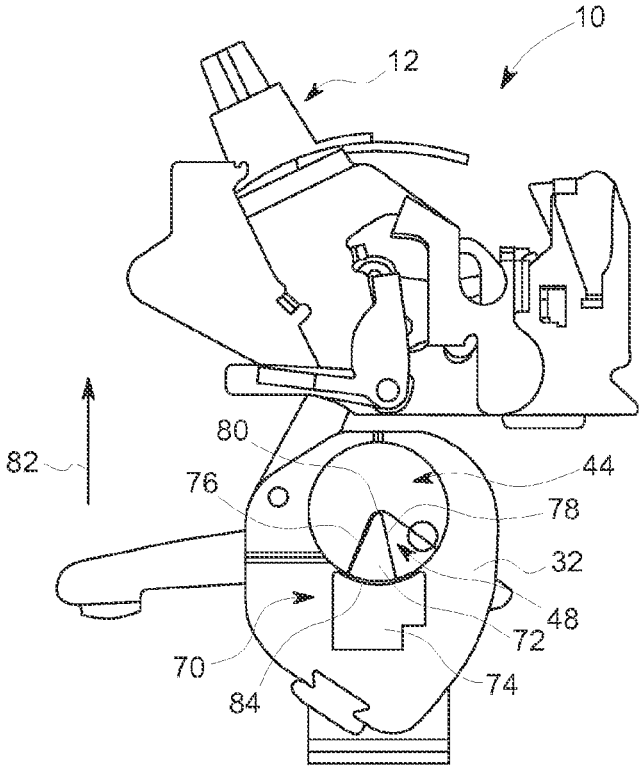
FIG. 5 is a side view of the circuit breaker crossbar assembly in a first rotational position.
Figure 6:
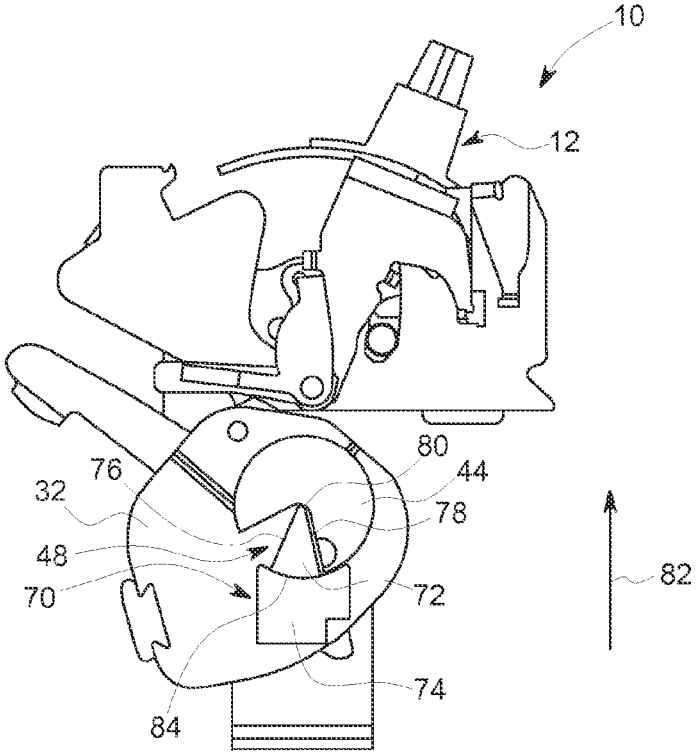
FIG. 6 is a side view of the circuit breaker crossbar assembly in a second rotational position.

In some embodiments, first support portion 44 further includes a convex outer wall 62 that extends from the first stop wall outer end 58 to the second stop wall outer end 60. Referring now to FIGS. 5 and 6, a support structure 70 for the crossbar 19 is illustrated. The support structure 70 extends from any suitable location on the circuit breaker base (not shown) and into the recess 48 of the first support portion 44 and into mechanical communication with the first support portion 44 of the crossbar 19. The support structure 70 includes a pivot portion 72 and a base portion 74. The base portion 74 extends from the circuit breaker base (not shown) and the pivot portion 72 extends from the base portion 74. The support structure 70 may be a single, integrally formed structure, such that the pivot portion 72 and the base portion 74 are integrally formed. Alternatively, the pivot portion 72 and the base portion 74 may be separately formed and operatively coupled to each other. Regardless of whether the support structure 70 is an integrally formed or operatively coupled structure, the support structure 70 may be integrally formed with the circuit breaker base (not shown) or operatively coupled thereto. In the case of an integrally formed assembly, the support structure 70 may be molded into the circuit breaker base. Alternatively, the support structure 70 may be coupled to an existing circuit breaker base (not shown), such that retrofitting an existing circuit breaker is facilitated.

The pivot portion 72 of the support structure 70 may be formed to define various geometries. In the illustrated embodiment, the pivot portion 72 has a triangular cross-section, such that a first wall 76 and a second wall 78 extend to an intersection point, referred to herein as a support end 80. Although a triangular geometry is illustrated and described herein, it is to be understood that alternative geometries may be employed to form the pivot portion 72. In other embodiments, the pivot portion 72 may have a generally rectangular cross-section with first and second walls 76, 78 arranged generally parallel, with the support end 80 disposed therebetween. In such an embodiment, the support end may include a radially oriented surface pivotably coupled to inner surface 54 and arranged to operatively facilitate rotation of crossbar 19 with respect to the longitudinal axis of crossbar 19. Preferably, the length of support end 80 between first and second walls and coupled to inner surface 54, is arranged to minimize the friction between support end 80 and support portion 44, while still providing sufficient support of crossbar 19. As will be appreciated from the description herein, the pivot portion 72 provides multiple benefits associated with operation of the crossbar assembly 18. In particular, structural support of the crossbar 19 is provided, as well as a reduced surface area of support upon which the crossbar 19 rotates than in the prior art and therefor resulting in reduced friction between the crossbar 19 and its support.

In an embodiment, the support end 80 of pivot portion 72 is pivotally coupled to the radially disposed inner surface 54 of the first support portion 44 to provide a supportive reaction force to the crossbar 19 in a first direction 82. The support end 80 is a pivoting end for the crossbar 19 to rotate upon. The crossbar 19 is further retained by the first bracket 24 and the second bracket 28, described above and shown in FIGS. 1 and 2. Interaction with the support end 80, the first bracket 24 and the second bracket 28 ensures constrained radial and axial movement of the crossbar 19 during rotation. Furthermore, based on the low surface area of contact between the support end 80 and the radially inner surface 54, a low friction force is present, thereby advantageously resulting in the circuit breaker operative to switch between ON and OFF conditions significantly faster than a crossbar assembly that is reliant on alternative means of constraint.

The first wall 76 and the second wall 78 of the pivot portion 72 provide rotational limiting positions of the crossbar 19 based on interaction of the walls with the first stop wall 50 and the second stop wall 52, respectively, of the first support portion 44. Specifically, the first wall 76 is positioned to engage the first stop wall 50 upon rotation of the crossbar 19 to a first rotational position (FIG. 5). Similarly, the second wall 78 is positioned to engage the second stop wall 52 upon rotation of the crossbar 19 to a second rotational position (FIG. 6). The first rotational position corresponds to a circuit breaker "ON" position and the second rotational position corresponds to a circuit breaker "OFF" or "TRIPPED" position. The first wall 76 and the second wall 78 thereby stop the crossbar 19 at predetermined positions corresponding to open and closed positions of the moveable contacts.

In an embodiment, in addition to supporting the pivot portion 72, the base portion 74 of the support structure 70 provides a guiding and/or support surface for the first support portion 44. For example in an embodiment, the base portion 72 includes a concave surface 84 having a curvature that corresponds to the curvature of the convex outer wall 62 of the first support portion 44. In the embodiment, shown in FIG. 5, a small clearance may be provided between the convex outer wall 62 and the concave surface 84 of the base portion 74, but during a transition between the first rotational position and the second rotational position, such corresponding geometries facilitate smooth rotation of the crossbar 19.

Advantageously, the embodiments described herein provide extremely low frictional forces on the crossbar 19 during rotation thereof, thereby resulting in fast and efficient transitioning of the circuit breaker 10 between conditions. Fast transitioning is particularly beneficial during a tripping event. Additionally, a small number of components are required to constrain the position of the crossbar 19 and to provide a low friction pivot, thereby reducing tolerance stack-up between the mechanism and the contact system. Additionally, the time required to operate the rotor is advantageously reduced, resulting in better short-circuit fault response improved product performance. Likewise, reliability of the circuit breaker is increased due to reduced friction fatigue.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A crossbar assembly for a circuit breaker, comprising:

an elongate crossbar comprising a longitudinal axis, a first end and a second end, having a support portion disposed therebetween, said crossbar coupleable to a plurality of moveable contacts of the circuit breaker; and rotatable with respect to the longitudinal axis between a first rotational position and a second rotational position, said support portion comprising a first stop wall and a second stop wall defining a recess therebetween, said support portion further defining an inner surface and a convex outer wall extending from a first stop wall outer end to a second stop wall outer end; and a support structure operatively disposed in said recess, the support structure comprising a base portion, and a pivot portion arranged to support said inner surface, wherein said support structure further comprises a first support wall arranged to operably engage said first stop wall upon a rotation of the crossbar toward the first rotational position, and a second support wall arranged to operably engage said second stop wall upon a rotation of said crossbar toward the second rotational position, wherein said base portion includes a concave surface having a corresponding curvature with said convex outer wall of said at least one support portion.

2. The circuit breaker crossbar assembly of claim 1, wherein said inner surface is defined by an intersection of said first stop wall and said second stop wall.

3. The circuit breaker crossbar assembly of claim 1, wherein said inner surface is coupled to and disposed between the said first stop wall and said second stop wall.

4. The circuit breaker crossbar assembly of claim 1, wherein said pivot portion comprises a triangular cross-section.

5. The circuit breaker crossbar assembly of claim 1, wherein said base portion and said pivot portion of said support structure are integrally formed.

6. The circuit breaker crossbar assembly of claim 1, wherein said base portion is integrally formed with a base of the circuit breaker.

7. The circuit breaker crossbar assembly of claim 1, wherein said base portion is operatively coupled to a base of the circuit breaker.

8. The circuit breaker crossbar assembly of claim 1, wherein said at least one support portion and said support structure are disposed between a pair of moveable contacts of the circuit breaker.

9. The circuit breaker crossbar assembly of claim 1, wherein said first rotational position of said crossbar corresponds to a circuit breaker "ON" position and said second rotational position of said crossbar corresponds to a circuit breaker "OFF" position.

10. The circuit breaker crossbar assembly of claim 1, wherein said first end and said second end of said crossbar are each rotatably coupled to respective brackets.

11. The circuit breaker crossbar assembly of claim 1, wherein said plurality of moveable contacts comprises a first moveable contact, a second moveable contact and a third moveable contact.

12. The circuit breaker crossbar assembly of claim 11, wherein said at least one support portion comprises a first support portion and a second support portion, the first support portion disposed between the first moveable contact and the second moveable contact, the second support portion disposed between the second moveable contact and the third moveable contact.

13. A circuit breaker comprising:

a plurality of moveable contacts configured to conduct current through said circuit breaker;

a mechanism configured to actuate movement of said plurality of moveable contacts;

a first bracket located on a first side of said circuit breaker;

a second bracket located on a second side of said circuit breaker;

an elongate crossbar comprising a longitudinal axis defining a first end operatively coupled to said first bracket, a second end operatively coupled to said second bracket, and at least one support portion disposed therebetween, said first end and said second end each rotatable between a first rotational position and a second rotational position and operatively coupled to said mechanism and to said plurality of moveable contacts to selectively rotate said plurality of moveable contacts;

said crossbar further comprising support portion having a first stop wall and a second stop wall defining a recess therebetween, said at least one support portion further defining an inner surface and a convex outer wall extending from a first stop wall outer end to a second stop wall outer end; and a support structure disposed in said recess, said support structure comprising a base portion, and a first support wall arranged to operably engage said first stop wall upon rotation of said crossbar to said first rotational position, and a second support wall arranged to operably engage said second stop wall upon rotation of said crossbar to said second rotational position, wherein said base portion includes a concave surface having a corresponding curvature with said convex outer wall of said at least one support portion, wherein said base portion includes a concave surface having a corresponding curvature with said convex outer wall of said at least one support portion.

14. The circuit breaker of claim 13, wherein said support structure further includes a pivot portion said pivot portion engaged with said inner surface of said at least one support portion, and wherein said pivot portion comprises a triangular cross-section.

15. The circuit breaker of claim 13 wherein said support portion comprises an inner surface defined by an intersection of said first stop wall and said second stop wall.

16. The circuit breaker of claim 13 wherein said support portion comprises an inner surface coupled to and disposed there between said first stop wall and said second stop wall.

17. The circuit breaker of claim 13, wherein said first end of said crossbar is rotatably coupled to said first bracket with a first pin joint and said second end of said crossbar is rotatably coupled to said second bracket with a second pin joint.

* * * * *